US009181076B2

(12) United States Patent
Tomlinson et al.

(10) Patent No.: US 9,181,076 B2
(45) Date of Patent: Nov. 10, 2015

(54) LIQUID TRANSFER SYSTEM

(71) Applicants: Michael Tomlinson, Spring Hill, FL (US); Harry Klepach, Sparks, NV (US)

(72) Inventors: Michael Tomlinson, Spring Hill, FL (US); Harry Klepach, Sparks, NV (US)

( * ) Notice: Subject to any disclaimer, the term of this patent is extended or adjusted under 35 U.S.C. 154(b) by 114 days.

(21) Appl. No.: 14/035,526

(22) Filed: Sep. 24, 2013

(65) Prior Publication Data

US 2014/0041756 A1 Feb. 13, 2014

Related U.S. Application Data

(63) Continuation-in-part of application No. 12/931,515, filed on Feb. 2, 2011, now abandoned.

(51) Int. Cl.
*B67D 3/00* (2006.01)
*B67D 7/02* (2010.01)

(52) U.S. Cl.
CPC ..... *B67D 3/0061* (2013.01); *B67D 7/0294* (2013.01)

(58) Field of Classification Search
CPC ..... B67D 3/0061; B67D 7/0294
USPC ..... 137/68.29, 68.3, 205, 590; 220/277, 220/86.1; 222/83–83.5; 141/2, 9, 18; 251/144
See application file for complete search history.

(56) References Cited

U.S. PATENT DOCUMENTS 2,047,049 A 7/1936 Allen
2,059,189 A 11/1936 Allen
3,101,188 A 8/1963 Newmiller et al.

*Primary Examiner* — Kevin Lee
*Assistant Examiner* — P. Macade Nichols
(74) *Attorney, Agent, or Firm* — James E. Brunton

(57) ABSTRACT

A novel system for safely transferring liquids from containers such as plastic jugs that are sealed by frangible seals, to conventional drums of the character having coupler-operated extractor valves. In one form of the invention, a standard coupler mechanism has been modified in a manner to provide means for rupturing the frangible seal of the sealed container without adversely affecting the manner in which the coupler is used to operate the extractor valve that is carried by the drum to which the liquid is to be transferred. Additionally, a novel adapter member has been provided for interconnecting the sealed container to the coupler mechanism.

12 Claims, 9 Drawing Sheets

LIQUID TRANSFER SYSTEM

CROSS-REFERENCE TO RELATED APPLICATIONS

This is a Continuation in Part of co-pending U.S. application Ser. No. 12/931,515 filed Feb. 2, 2011.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to liquid transfer systems for transferring liquid from one container to another. More particularly, the liquid transfer system of the invention permits the safe and efficient transfer of liquid from a container sealed by a frangible seal to a drum type container of the character having a coupler operated extractor valve.

2. Description of Related Art Including Information Disclosed Under 37 CFR 1.97 and 1.98

A number of different types of reusable systems for the storage, shipment and transport of liquid formulations have been suggested. One of the most advanced of such systems was developed by and is presently commercially available from Micro Matic, Inc. of Northridge, Calif.

The Micro Matic system is basically a two-part system which comprises a coupler operated extractor valve which is interconnectable with a conventional drum via existing threaded connections and a cooperating coupler which is operably coupled with the extractor valve to allow drum emptying through the use of a separate pumping system. The extractor valve apparatus which can either remain with the drum after emptying, or can be removed for drum processing, includes a valve body and a down tube connected to the valve body which extends to the bottom of the drum to permit the complete transfer of liquid from the drum.

Recently a need has developed to safely transfer liquids, including hazardous liquids, from containers such as plastic jugs that are sealed by frangible seals, to conventional drums of the character having coupler operated extractor valves. Problems related to such transfers include providing means for safely rupturing the frangible seal of the plastic jugs and means for operating the coupler operated extractor valve of the drum in a manner to permit the liquid to be safely transferred from the plastic jug into the reservoir of the drum. As will be better understood from the discussion which follows, after carefully analyzing these problems the present inventor solved them by providing an elegant but relatively simple closed system that includes a modified coupler which, upon normal operation, safely ruptures the frangible seal of the plastic jug and at the same time opens the coupler operated extractor valve on the drum so as to permit fluid to flow freely from the plastic jug into the reservoir of the drum. Without the present invention, in order to transfer liquids from a sealed plastic jug to the reservoir of a drum having a coupler-operated extractor valve, it would be necessary to remove the extractor valve from the drum, manually rupture the foil seal on the plastic jug and then pour the contents of the plastic jug into the drum. Such a procedure would be not only time-consuming but extremely dangerous if the liquid in the plastic jug was a hazardous liquid.

BRIEF SUMMARY OF THE INVENTION

It is a primary object of the present invention to provide a system for safely transferring liquids from containers such as plastic jugs that are sealed by frangible seals, to conventional drums of the character having coupler operated extractor valves.

Another object of the invention is to provide a system of the aforementioned character in which a standard coupler mechanism has been modified in a manner to provide means for rupturing the frangible seals of the sealed containers without adversely affecting the manner in which the coupler is used to operate the extractor valve that is carried by the drum to which the liquid is to be transferred.

Another object of the invention is to provide a system as described in the preceding paragraphs in which the coupler has been modified to include a seal rupturing assembly that is carried within the housing of the coupler.

Another object of the invention is to provide a system of the class described in the preceding paragraph in which the seal rupturing assembly of the modified coupler is operated by the operation of actuating handle of the actuating assembly that is pivotally connected to the coupler body.

Another object of the invention is to provide a system of the character described in the preceding paragraphs in which the seal rupturing assembly includes a flat cutter that efficiently and uniformly cuts the seal of the sealed container and reduces the amount of stroke required by the cutter actuating mechanism to fully rupture the seal.

Another object of the invention is to provide a system for safely transferring liquids from containers such as plastic jugs that are sealed by frangible seals, which includes a novel rinsing system for quickly and efficiently rinsing the plastic jug following rupture of the frangible seal thereof.

Another object of the invention is to provide a system of the character described in the preceding paragraph in which the rinsing system includes a quick coupling mechanism for quickly and efficiently coupling the rinsing system with a source of cleaning fluid under pressure.

Another object of the invention is to provide a system as described in the preceding paragraphs which includes a pressure relief valve that allows for blow-off of only the rinse water if the plastic jug is over pressurized.

Still another object of the invention is to provide an apparatus in which the rinsing system includes a venting system that functions to reduce the tendency of the plastic jug to collapse thereby increasing fluid flow.

Another object of the invention is to provide an apparatus of the character described in the preceding paragraphs in which the rinsing system is uniquely designed in a manner to prevent contaminants such as chemicals and contaminated rinse water from escaping into the environment.

Another object of the invention is to provide a system of the character described in the preceding paragraphs that is of simple straight forward design and is quick and easy to use to safely accomplish the liquid transfer.

Another object of the invention is to provide a system of the character described that is inexpensive to produce and one that can be used with a minimum of training.

DETAILED DESCRIPTION OF THE INVENTION

Figure 1:
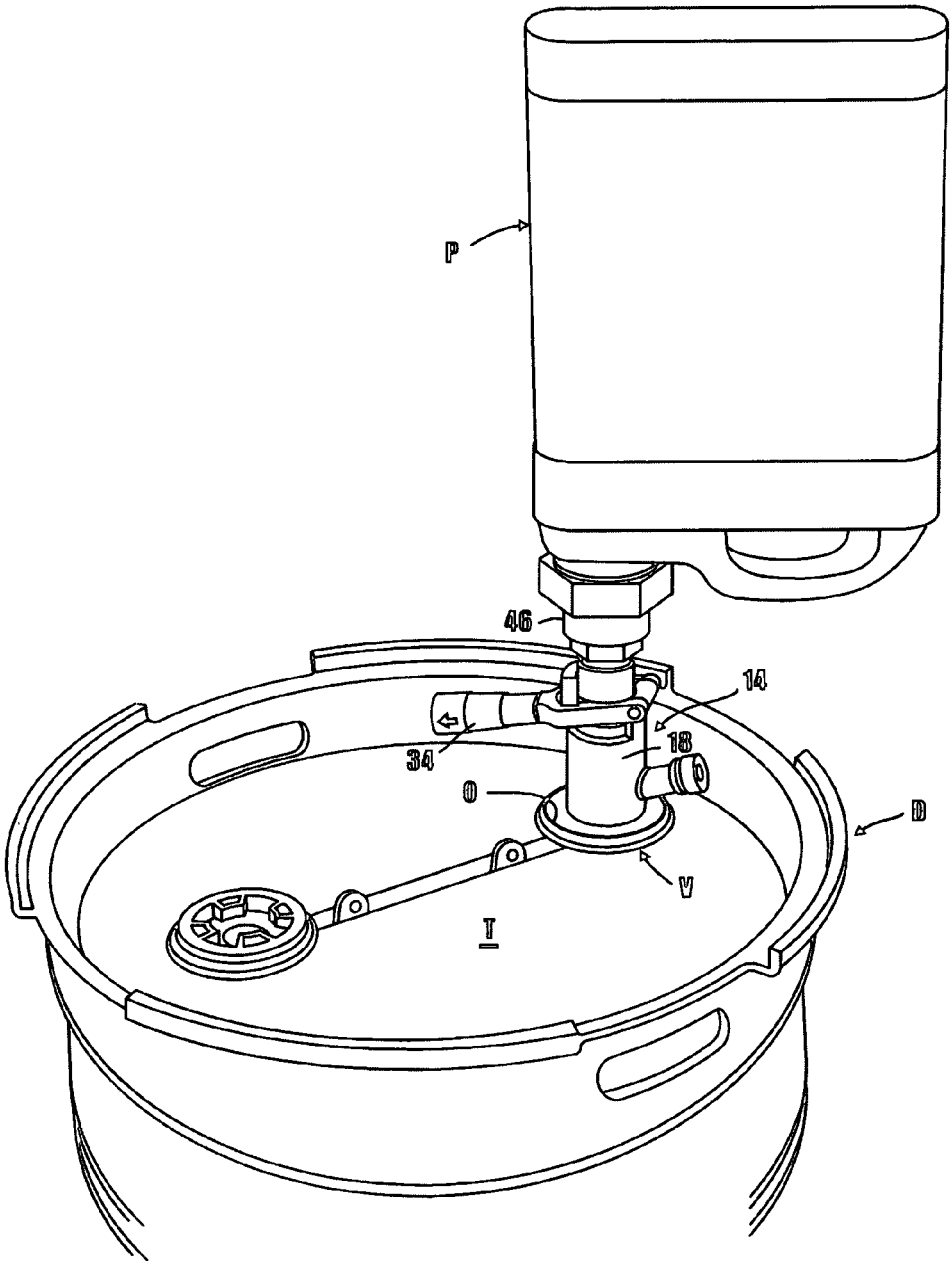
FIG. 1 is a generally perspective, diagrammatic view showing one form of the liquid transfer system of the invention as it appears following interconnection of a plastic jug having a frangible seal with a conventional drum of the character having a coupler operated extractor valve.

Referring to the drawings and particularly to FIG. 1, one form of the liquid transfer system of the invention is there shown and generally designated by the numeral 14. In FIG. 1, the liquid transfer system 14 is shown as it appears when interconnecting a conventional prior art plastic jug "P" having a frangible seal "S" with a conventional drum "D" of the character having a conventional coupler-operated extractor valve assembly which is generally designated in the drawing as "V". Drum "D" is of a conventional type having a threaded opening "O" provided in the top wall "T" of the drum. In FIG. 1, the Micro Matic coupler-operated extractor valve assembly "V" is shown threadably interconnected with drum "D" with the valve body "B" thereof extending through opening "O" which is the access opening to the reservoir. Valve assembly "V" is further illustrated in FIG. 6 of the drawings and as there illustrated includes, in addition to valve body "B" which includes a connector port "CP", a valve mechanism "M" and a down tube "DT" which is connected to the valve body and extends downwardly to a location proximate the bottom of the liquid containing drum "D". Valve assembly "V" is of the character manufactured and sold by Micro Matic U.S.A., Inc. of Northridge, Calif. and the details of construction and operation of the valve assembly are fully described in technical publications available from Micro Matic U.S.A., Inc.

Figure 5:
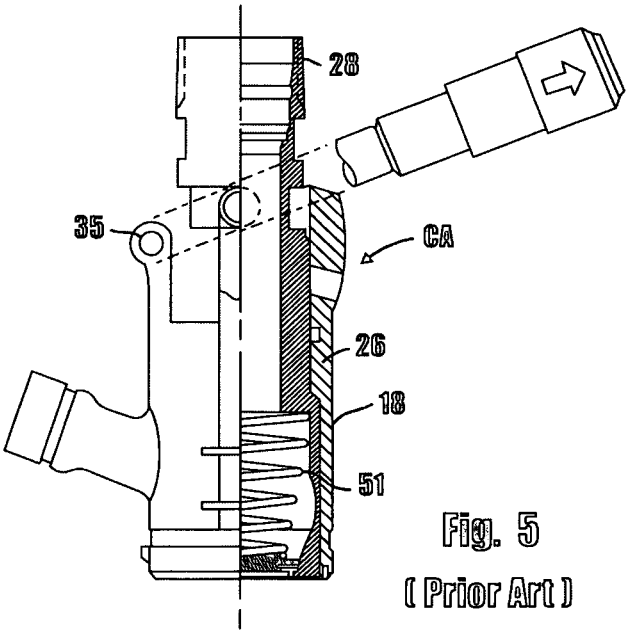
Fig. 5 ( Prior Art )
FIG. 5 is a side elevational, partially cross-sectional view of a conventional coupler of the character that is used for operating the extractor valve of a conventional drum.

FIG. 5 of the drawings illustrates the configuration of a conventional Micro Matic coupler assembly "CA" that is of the character which, in a manner presently to be described, is modified to provide a critical part of the liquid transfer system 14 of the present invention. Coupler assembly "CA" is manufactured and sold by Micro Matic U.S.A., Inc. of Northridge, Calif. and the details of construction and operation of the coupler assembly "CA" are fully described in technical publications available from Micro Matic U.S.A., Inc.

In operation of the prior art Micro Matic system, the coupler assembly "CA" is interconnected with the valve assembly "V" via a conventional bayonet connection by inserting the lower portion of the coupler assembly into the connector port "CP" of the valve assembly and then rotating the assembly so that the lower portion of the coupler assembly is urged into sealable interconnection with the valve mechanism. This type of coupler-extractor valve interface is of a character well understood by those skilled in the art and is fully described in technical publications available from Micro Matic U.S.A., Inc. of Northridge, Calif.

Figure 2:
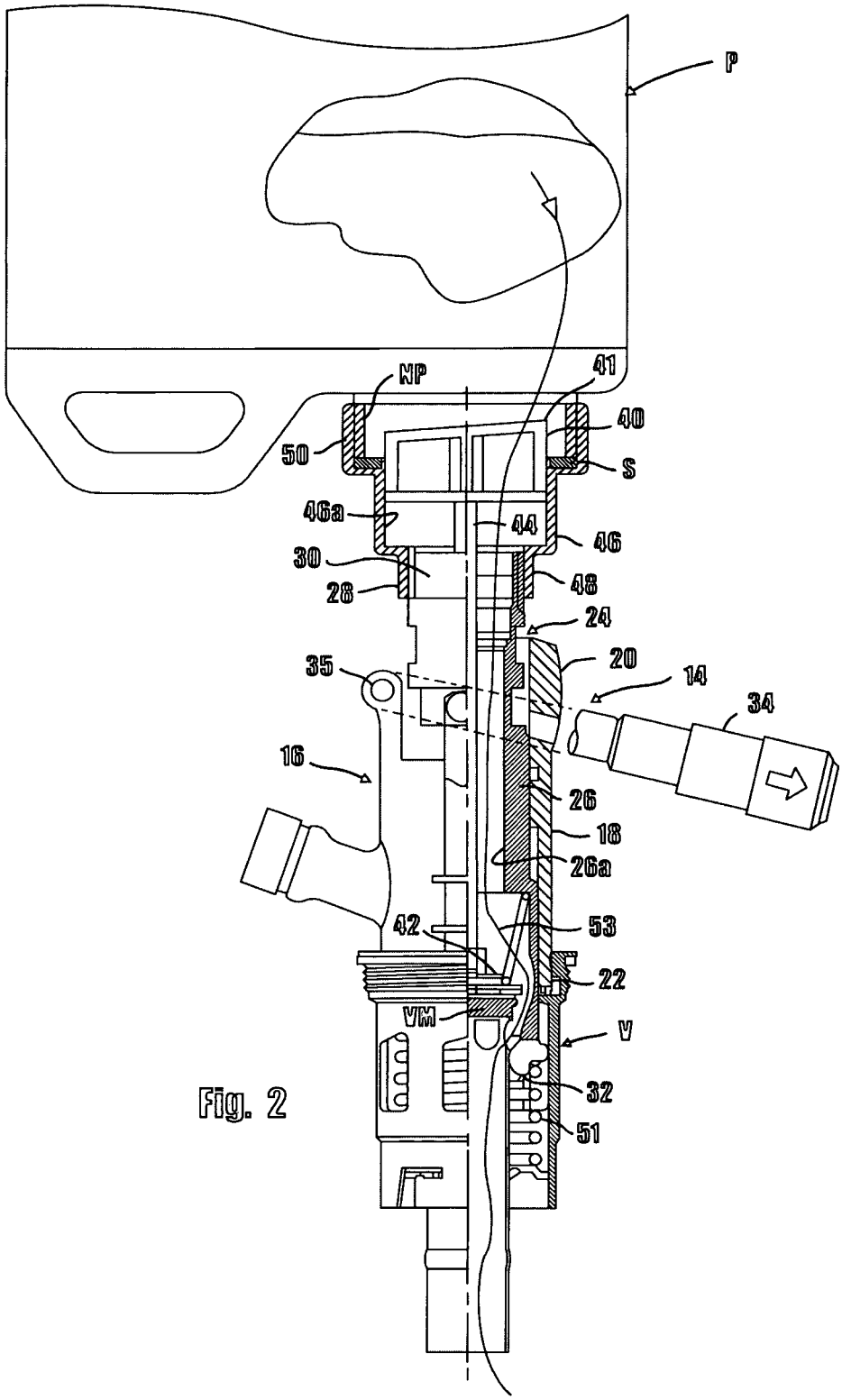
FIG. 2 is a side elevational view, partly in cross-section that is similar to FIG. 1 and shows the liquid transfer system of the invention interconnecting a plastic jug having a frangible seal with a conventional drum of the character having a coupler-operated extractor valve.
Figure 3:
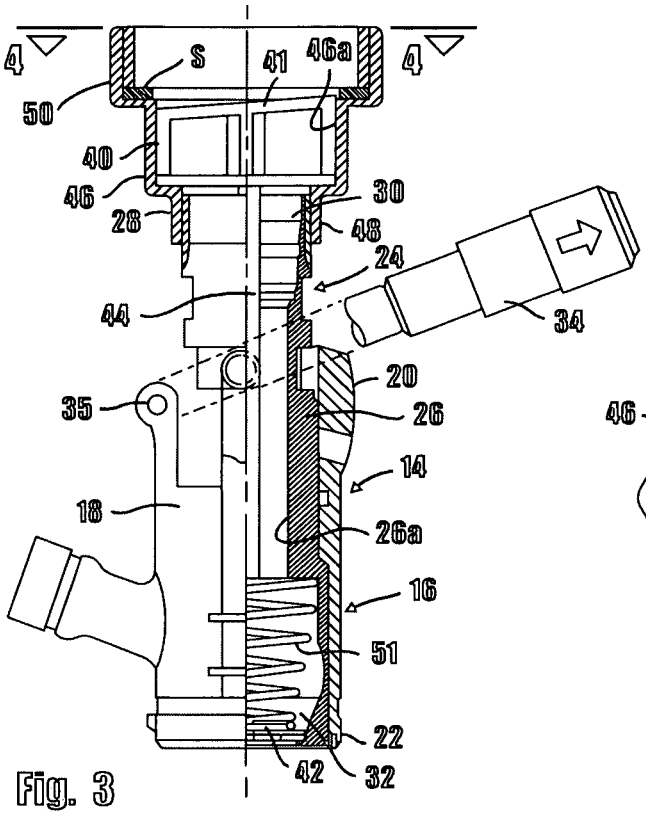
FIG. 3 is a side elevational view, partly in cross-section of one form of the liquid transfer system of the invention.
Figure 4:
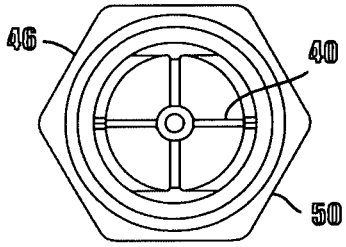
FIG. 4 is a view taken along lines 4-4 of FIG. 3.

Turning now to FIGS. 2 and 3 of the drawings, the modified coupler assembly 16 of the present invention can be seen to comprise a coupler body 18 having an upper portion 20 and a lower portion 22. Disposed within the coupler body 18 is the novel actuating assembly 24 of the invention that includes an actuating member 26. In a manner presently to be described, actuating member 26 functions to move the valve member "VM" of the extractor valve assembly to an open position (see also FIG. 9). Actuating member 26 has an interior chamber **26*a* and an externally threaded neck portion 28 and is provided with an inlet port 30 and an outlet port 32. As seen in FIGS. 2 and 3, the actuating member is movable within the coupler body from the first at rest position shown in FIG. 3 to the second valve operating position shown in FIG. 2. Actuating assembly 24 further includes an actuating handle 34 that is pivotally connected to coupler body 18 at a pivot point 35 and is movable from the first upraised position shown in FIG. 3 to the second lowered position shown in FIG. 2**.

An important feature of the present invention is a cutter assembly 36 that is carried by the coupler assembly 16. This important assembly here includes a generally circular shaped punch cutter 40 for cutting the frangible seal, or frangible foil "S" of the plastic jug "P". In a manner presently to be described, upon movement of actuating member 26 to its second position, the punch cutter 40 is movable from the first position shown in FIG. 3 to the second seal cutting position shown in FIGS. 2 and 9.

Turning now to FIGS. 2 and 3 of the drawings, the modified coupler assembly 16 of the present invention can be seen to comprise a coupler body 18 having an upper portion 20 and a lower portion 22. Disposed within the coupler body 18 is the novel actuating assembly 24 of the invention that includes an actuating member 26. In a manner presently to be described, actuating member 26 functions to move the valve member "VM" of the extractor valve assembly to an open position (see also FIG. 9). Actuating member 26 has an interior chamber

26*a* and an externally threaded neck portion 28 and is provided with an inlet port 30 and an outlet port 32. As seen in FIGS. 2 and 3, the actuating member is movable within the coupler body from the first at rest position shown in FIG. 3 to the second valve operating position shown in FIG. 2. Actuating assembly 24 further includes an actuating handle 34 that is pivotally connected to coupler body 18 at a pivot point 35 and is movable from the first upraised position shown in FIG. 3 to the second lowered position shown in FIG. 2.

Figure 9:
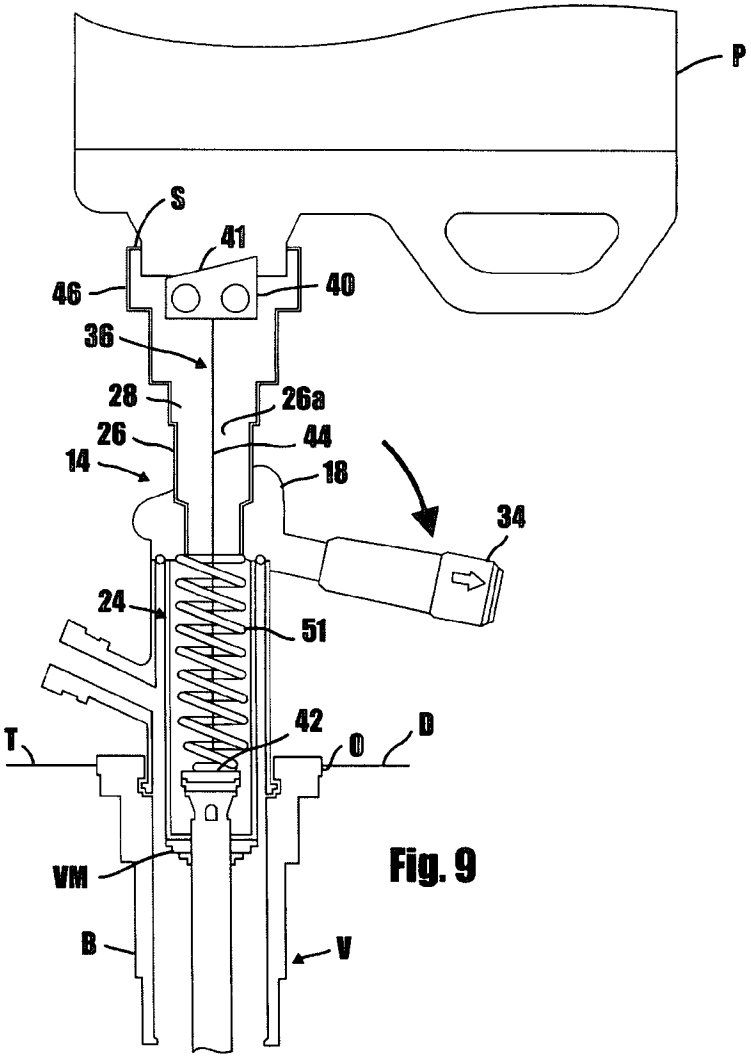
FIG. 9 is a generally diagrammatic view, similar to FIG. 8, illustrating the operation of the seal rupturing assembly to rupture the closure seal located in the threaded neck portion of the plastic jug.
Figure 8:
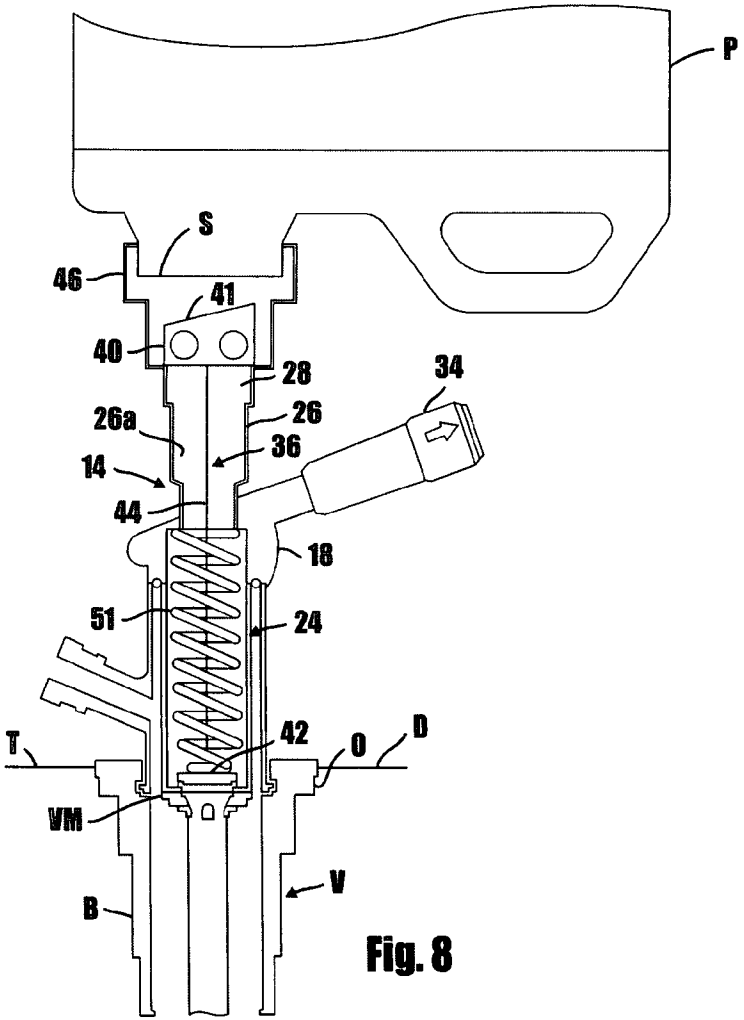
FIG. 8 is a generally diagrammatic view similar to FIG. 2, but further illustrating the location and configuration of the seal rupturing assembly of the modified coupler.

In addition to punch cutter 40, which has a cutting edge 41 for cutting the frangible seal of the first liquid container, cutter assembly 36 also includes a base member 42 and a punch rod 44 that is connected to and spans the punch cutter and the base member (see also FIGS. 8 and 9).

Forming another important part of the liquid transfer system of the present invention is a uniquely configured adapter member 46 (FIG. 6) that functions to threadably connect the first container "P" to the coupler body 18 of the coupler assembly 16. Adapter member 46, which has an interior chamber 46*a*, includes a first threaded portion 48 having interior threads 48*a* for threadable interconnection with the threaded neck portion 28 of the actuating member 26 and a second, larger diameter threaded portion 50 having interior threads 50*a* for threadable interconnection with the threaded neck portion "NP" of the first liquid container "P".

In using the liquid transfer system of the invention, the first threaded portion 48 of the adapter member 46 is first threadably interconnected with the threaded neck portion of the actuating member 26. This done, the threaded neck portion of the first liquid container "P" is threadably connected to the second threaded portion 50 of the adapter member. Next, the assemblage thus formed is interconnected with the valve assembly "V" in the manner described in the preceding paragraphs and as illustrated in FIGS. 2, 8 and 9 of the drawings. A downward pressure exerted on the actuating handle 34 of the coupler assembly in the manner shown in FIGS. 2 and 9 of the drawings will cause the actuating member 26 of the coupler mechanism to move downwardly against the urging of a coil spring 51 that is carried within the adapter member in a manner to open the normally closed valve. As best seen in FIGS. 8 and 9 of the drawings, as the actuating member 26 moves downwardly, the punch cutter 40 of the cutter assembly 36 will move into the foil, or seal cutting position shown in FIG. 9 of the drawings, cleanly cutting the foil seal "S". With the foil seal thusly cut, the fluid contained within the first container "P" will be permitted to safely and securely flow from the first container through the actuating member and into the down tube "DT" in the direction of the arrows 53 of FIG. 2 of the drawings. After the fluid has been safely transferred to the drum "D", the first container "P" can be safely discarded. Once again, the operation of the conventional Micro Matic coupler assembly and the conventional Micro Matic coupler-operated extractor valve assembly "V" is well understood by those skilled in the art and is fully described in Micro Matic U.S.A., Inc. technical publications.

Figure 14:
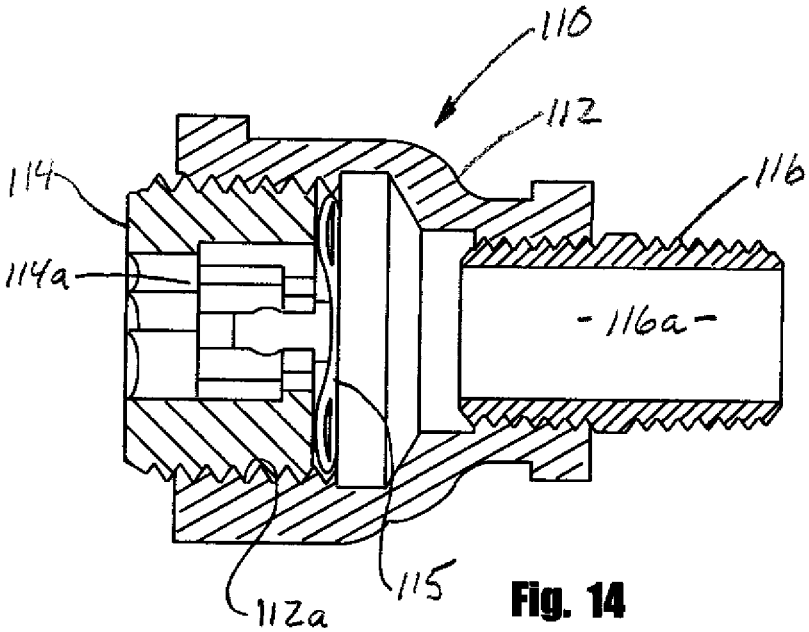
FIG. 14 is a greatly enlarged cross-sectional view of the vent assembly of the alternate form of liquid transfer system.
Figure 15:
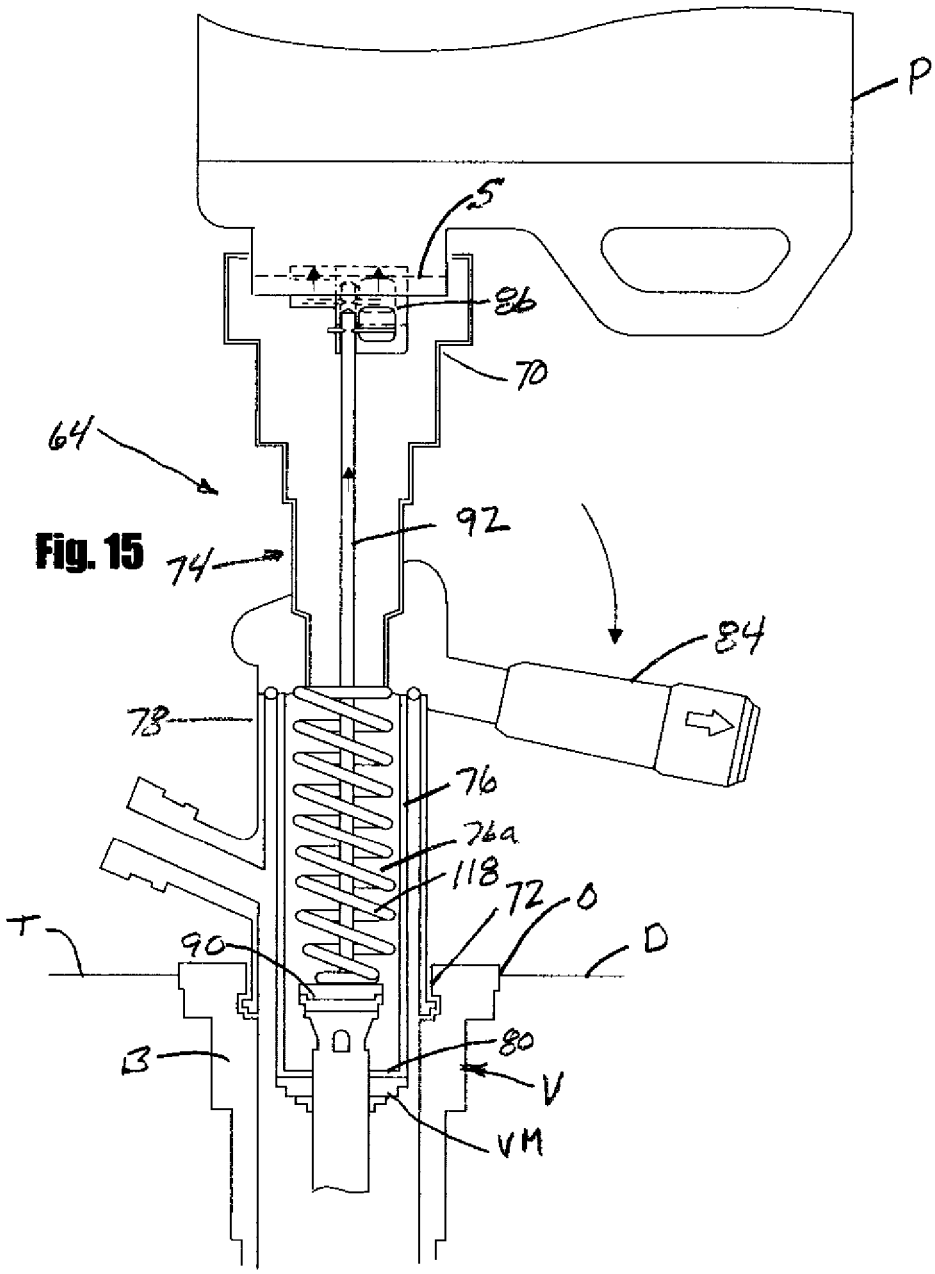
FIG. 15 is a generally diagrammatic, side elevational view showing the liquid transfer system of the alternate form of the invention interconnected with a plastic jug having a frangible seal and with a conventional drum of the character having a coupler-operated extractor valve and illustrating the operation of the seal rupturing assembly to rupture the closure seal located in the threaded neck portion of the plastic jug.

Referring now to FIGS. 10 through 15, an alternate form of the liquid transfer system of the invention is there shown and generally designated by the numeral 64. This embodiment of the invention is similar in many respects to the embodiment of the invention shown in FIGS. 1 through 9 and like numerals are used in FIGS. 10 through 15 to identify like components. In FIG. 15 the liquid transfer system 64 is shown as it appears when interconnecting a conventional prior art plastic jug "P" having a frangible seal "S" with a conventional drum "D" of the character having a conventional coupler-operated extractor valve assembly which is generally designated in the drawing as "V". Drum "D" is of a conventional type having a threaded opening "O" provided in the top wall "T" of the drum. In FIG. 15, the Micro Matic coupler-operated extractor valve assembly "V" is shown threadably interconnected with drum "D" with the valve body "B" thereof extending through opening "O" which is the access opening to the reservoir. Valve assembly "V", which was earlier described in greater detail, is further illustrated in FIG. 6 of the drawings.

Figure 10:
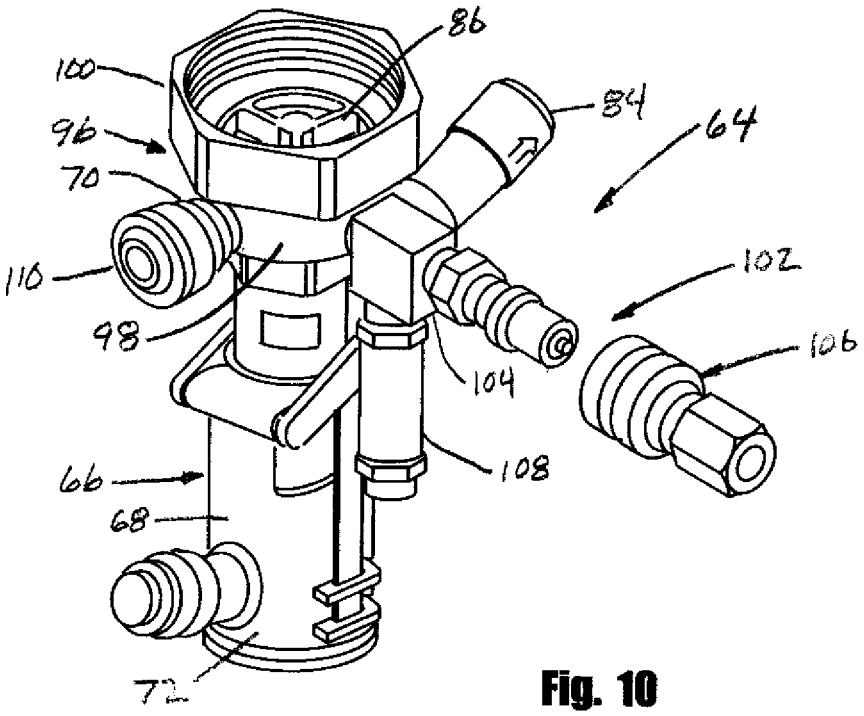
FIG. 10 is a generally perspective view of an alternate form of the liquid transfer system of the invention for safely transferring liquids from containers such as plastic jugs that are sealed by frangible seals, to conventional drums of the character having coupler operated extractor valves.
Figure 12:
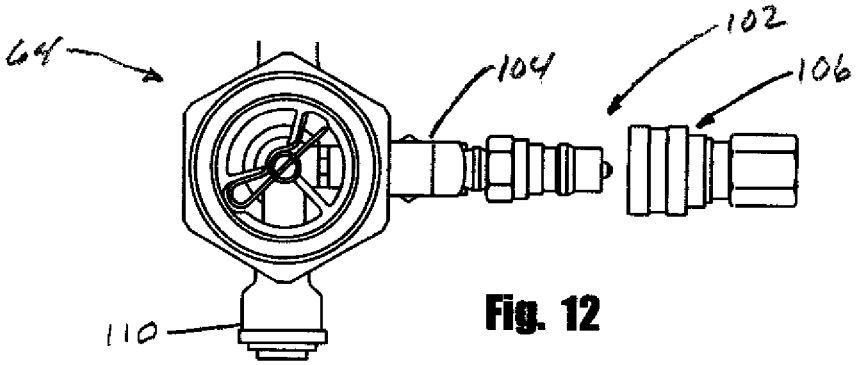
FIG. 12 is a top plan view of the alternate form of liquid transfer system shown in FIG. 10.
Figure 11:
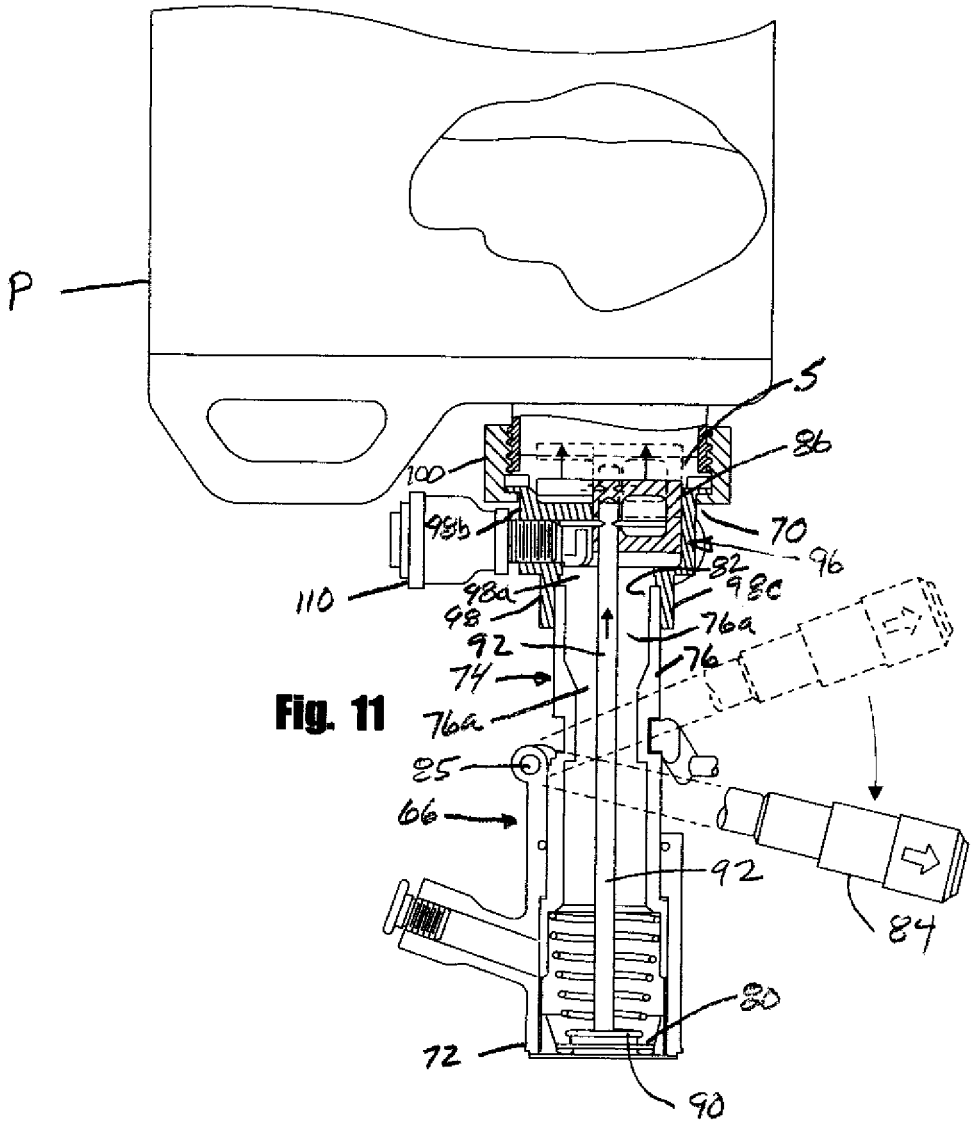
FIG. 11 is a side elevational view, partly in cross-section of the alternate form of the liquid transfer system of the invention shown in FIG. 10 as it appears following interconnection with a container such as a plastic jug.
Figure 13:
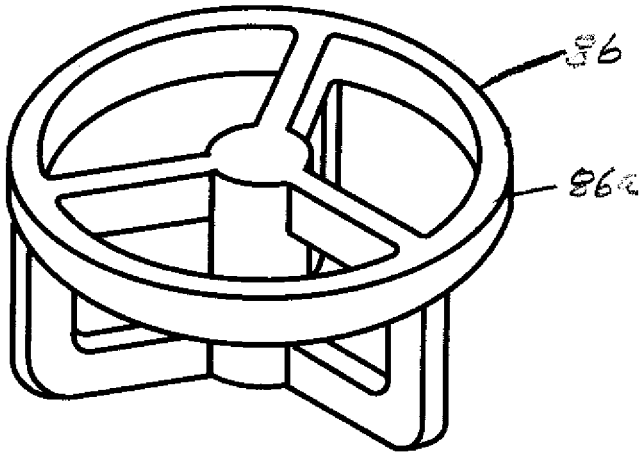
FIG. 13 is a generally perspective view of the seal rupturing assembly of the alternate form of liquid transfer system that functions to rupture the closure seal located in the threaded neck portion of the plastic jug.

As best seen in FIG. 10 of the drawings, this alternate form of the liquid transfer system 64 here comprises a coupler assembly 66 having a coupler body 68 having an upper portion 70 and a lower portion 72. Disposed within the coupler body 68 is the novel actuating assembly 74 of the invention (FIG. 11). In a manner presently to be described, assembly 74 functions to move the valve member "VM" of the extractor valve assembly to the open position shown in FIG. 15 of the drawings. Actuating assembly 74 includes an actuating member 76 having an interior chamber 76*a* that is provided with an inlet port 80 and an outlet port 82 (FIG. 11).

As before, actuating member 76 is movable within the coupler body from a first at rest position to a second valve operating position shown in FIG. 15. In addition to actuating member 76, actuating assembly 74 also includes an actuating handle 84 that is pivotally connected to coupler body 78 at a pivot point 85 and is movable from a first upraised position shown by the dotted lines in FIG. 11 to the second lowered position shown by the solid lines in FIG. 11.

An important feature of the present invention is a cutter assembly 86 that is carried by actuating member 76 includes a generally circular shaped punch cutter 88 (see FIG. 13) which functions to cut the frangible seal, or frangible foil "S" of the plastic jug "P". In a manner presently to be described, upon movement of actuating member 76 to its second position, the punch cutter 86 is movable from a first position to a second seal cutting position shown in FIG. 15. In addition to punch cutter 86, which has a cutting edge 86*a* for cutting the frangible seal of the first liquid container, cutter assembly 86 also includes a base member 90 and a punch rod 92 that is connected to and spans the punch cutter and the base member (see FIG. 11).

Forming another important part of the liquid transfer system of the present invention is a uniquely configured adapter assembly 96 that functions to threadably connect the first container "P" to the coupler assembly 66. Adapter assembly 96 here comprises a housing 98 having an interior chamber 98*a*, an upper portion 98*b* and a threaded lower portion 98*c* for threadable interconnection with the threaded neck portion of the actuating member 76 (FIG. 11). Adapter assembly 96 also includes a threaded connector ring 100 that is rotatably connected to the upper portion of housing 98. Connector ring 100 functions to interconnect the adapter assembly with the first container, or plastic jug "P".

Another important feature of the adapter assembly 96 of the invention is the provision of a rinsing assembly 102 for rinsing the first container or plastic jug "P". Rinsing assembly 102, which is connected to housing 98 in the manner shown in FIGS. 10 and 11 of the drawings, comprises a connector body 104 and a quick coupling assembly 106. Quick coupling assembly 106 functions to connect the rinsing assembly with a source of fluid under pressure (not shown). The rinsing assembly, including the quick coupling assembly, is of the character well understood by those skilled in the art and is readily commercially available from several sources including Parker Hannifin of Cleveland, Ohio and is offered for sale by this company under the name and style "Snap-Tite 72 Series".

Also forming a part of the rinsing assembly of the present invention is the important pressure relief valve assembly 108 that is connected to and extends from connector body 104. Pressure relief valve assembly 108 functions to prevent over pressuring of first container or plastic jug "P" during the rinsing operation. This valve assembly is of a character well understood by those skilled in the art and is readily commercially available from several sources including the F. C. Kingston Co. of Torrance, Calif. which is sold under the name and style "Model 100SS safety valve".

Still another important feature of the adapter assembly 96 of the invention is the provision of a vent assembly 110 that is connected to the housing 98 of adapter assembly 96 in the manner shown in FIGS. 10 and 11. As illustrated in FIG. 14 of the drawings, vent assembly 110 includes an interiorly threaded vent housing 112 having an interior space 112*a*, an externally threaded breather plug 114 threadably connected to vent housing 112 and extending into the interior space thereof and a conventional umbrella check valve 115 disposed within interior space 112*a*. Vent assembly 110 also includes a threaded nipple 116 that is threadably connected to vent housing 112 and is also threadably connected to housing 98 of the adapter assembly. Breather plug 114 includes a passageway 114*a* that communicates with passageway 116*a* of the threaded nipple when the umbrella check valve 115 is in an open position.

Use of the apparatus of this latest form of the invention is similar to that described in connection with the embodiment of FIGS. 1 through 9 and this previous description should once again be reviewed along with a re-review of FIGS. 8 and 9 of the drawings. As in the earlier described embodiment, the first step in the liquid transfer operation of this latest form of the invention is to connect the coupler assembly 66 coupler to the container, or jug "P". This is accomplished by first removing the closure cap from container and then connecting the container to the coupler neck by interconnecting the threaded connector ring 100 to the threaded outlet of the container. More particularly, the container "P" can be securely coupled with the coupler neck by turning the connector ring in a clockwise direction until it is snug.

Figure 6:
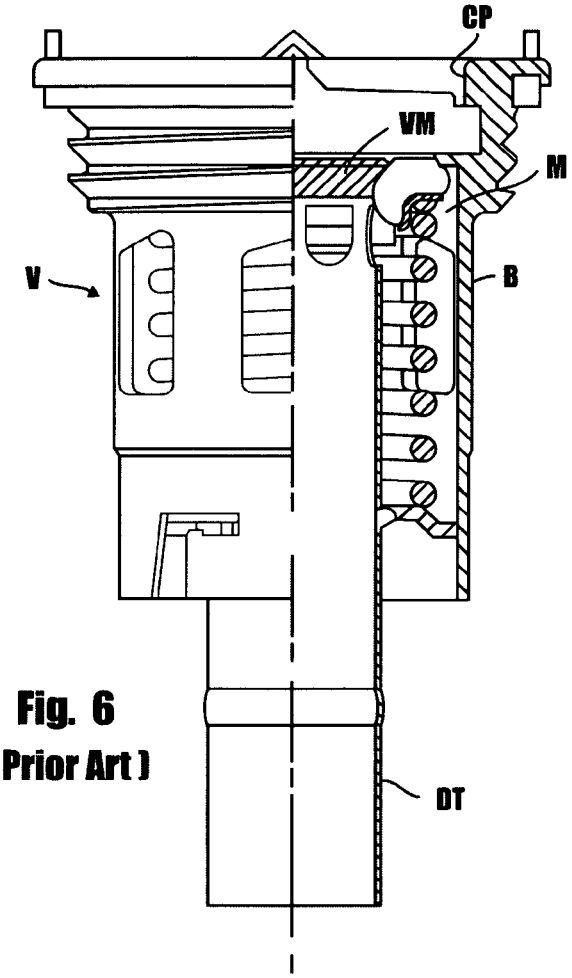
Fig. 6 ( Prior Art )
FIG. 6 is a side elevational, partially cross-sectional view of a conventional coupler-operated extractor valve.
Figure 7:
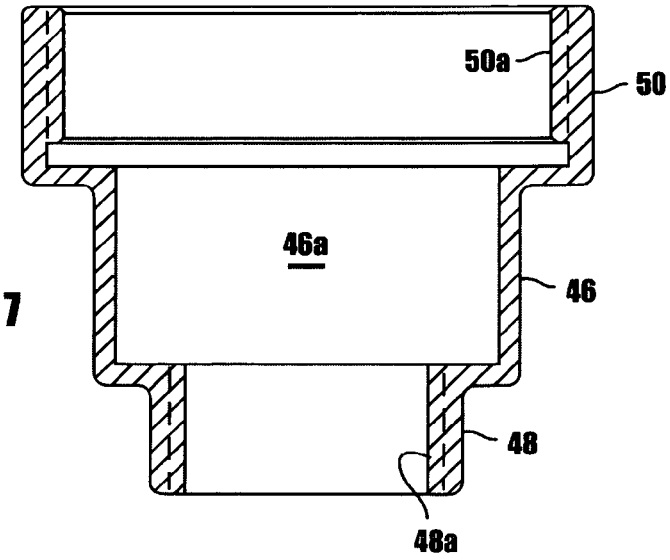
FIG. 7 is a side elevational cross-sectional view of one form of the adapter member of the invention for interconnecting a plastic jug having a frangible seal with the modified coupler assembly of the invention.

This done, the assemblage made up of the coupler assembly and the container is connected to the container valve "V" via the previously discussed conventional bayonet connection by inserting the lower portion of the coupler assembly into the connector port "CP" of the valve assembly and then rotating the assembly so that the lower portion of the coupler assembly is urged into sealable interconnection with the valve mechanism (see FIG. 6). Next, the actuating handle 84 is pushed into a downward position in the manner shown in FIG. 15 of the drawings. This will cause the actuating member 76 of the coupler mechanism to move downwardly against the urging of the coil spring 51 that is carried within the valve assembly (see FIG. 2) in a manner to open the normally closed valve. As illustrated in FIG. 15, as the actuating member 76 moves downwardly, the punch rod 92 of the apparatus will move the punch cutter of the cutter assembly 86 into the foil, or seal cutting position thereby cleanly cutting the foil seal "S". With the foil seal thusly cut, the fluid contained within the first container "P" will be permitted to safely and securely flow from the first container through the actuating member and into the down tube "DT". After the fluid has been safely transferred to the drum "D", and with the handle 84 remaining in the downward position, the rinsing operation can be commenced.

The rinsing operation is conducted by first connecting the rinsing assembly with the source of fluid under pressure through use of the quick coupling assembly 106. With the actuating handle 84 in the downward position, the rinsing solution can be forced through the first container, or plastic jug "P" a sufficient number of times to fully rinse the container. As previously mentioned, if during the rinsing operation should the plastic jug become over pressurized, the pressure relief valve assembly 108 will safely and efficiently permit blow-off of the rinsing solution.

Once the rinsing operation is completed, the coupler assembly can be removed from the coupler-operated extractor valve assembly "V" by rotating the coupler assembly in a counterclockwise direction. This done, the empty and fully rinsed plastic jug can be unthreaded from the connector ring 100 and safely discarded.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. In a liquid transfer system for transferring liquid from a first liquid container having a threaded neck portion including an outlet sealed by frangible seal to a second liquid container having a reservoir, an access opening to the reservoir and an extractor valve assembly connected to the access opening, which extractor valve assembly includes a valve member movable from a closed position blocking liquid flow through the extractor valve assembly to an open position permitting liquid flow there through, the liquid transfer system comprising:

(a) a coupler assembly removably connected to the extractor valve assembly of said second liquid container, said coupler assembly comprising:

(i) a coupler body having an upper portion and a lower portion;

(ii) an actuating assembly carried by said coupler body for moving the valve member of the extractor valve assembly to an open position, said actuating assembly including an actuating member having a threaded neck portion having an inlet port and an outlet port; and (iii) a cutter assembly carried by said actuating member, said cutter assembly including a punch cutter movable from a first position to a second frangible seal cutting position upon movement of said valve member of the extractor valve assembly to an open position; and (b) an adapter assembly for interconnecting the first container with said coupler body of said coupler assembly, said adapter assembly comprising:

(i) a housing having an interior chamber, an upper portion and a threaded lower portion for threadable interconnection with said threaded neck portion of said actuating member;

(ii) a rinsing assembly connected to said housing of said adapter assembly for rinsing the first container, said rinsing assembly including a fluid passageway and communication with said interior chamber of said housing of said adapter assembly;

(iii) a threaded connector ring connected to said upper portion of said housing of said adapter assembly for interconnecting said adapter assembly with the first container; and (iv) a vent assembly connected to said housing of said adapter assembly said vent assembly including a vent housing having an interior space and a passageway in communication with said interior chamber of said housing and a check valve disposed within said interior space of said vent housing.

2. In a liquid transfer system as defined in claim 1 in which said actuating assembly comprises:

(a) an actuating member having an interior chamber, said actuating member and being movable within said coupler body from a first position to a second position; and (b) an actuating handle pivotally connected to said coupler body for movement from a first position to a second position to move said actuating member to said second position.

3. In a liquid transfer system as defined in claim 2 in which said cutter assembly of said coupler assembly is telescopically movable within said interior chamber of said housing of said adapter assembly.

4. In a liquid transfer system as defined in claim 2 in which said punch cutter of said cutter assembly includes a cutting edge for cutting the frangible seal of the first liquid container.

5. In a liquid transfer system as defined in claim 2 in which said cutter assembly includes base member and a punch rod connected to and spanning said punch cutter and said base member.

6. In a liquid transfer system for transferring liquid from a first liquid container having a threaded neck portion including an outlet sealed by frangible seal to a second liquid container having a reservoir, an access opening to the reservoir and an extractor valve assembly connected to the access opening, which extractor valve assembly includes a valve member movable from a closed position blocking liquid flow through the extractor valve assembly to an open position permitting liquid flow there through, the liquid transfer system comprising:

(a) a coupler assembly removably interconnectable with the extractor valve assembly of said second liquid container, said coupler assembly comprising:

(i) a coupler body having an and axial centerline, and inlet port and an outlet port;

(ii) an actuating assembly operably associated with said coupler body for moving the valve member of the extractor valve assembly to an open position, said actuating assembly comprising an actuating member movable within said coupler body from a first position to a second position, said actuating member having a threaded neck portion and an interior chamber, said actuating assembly further including an actuating handle pivotally connected to said coupler body for movement from a first position to a second position to move said actuating member to said second position;

(iii) a cutter assembly carried by said coupler assembly, said cutter assembly including a punch cutter movable from a first position to a second frangible seal cutting position upon movement of said actuating member to said second position;

(b) an adapter assembly for interconnecting the first container with said second liquid container, said adapter assembly comprising:

(i) a housing having an upper portion, a lower portion, and an interior chamber, said lower portion having a threaded collar for threadable interconnection with said threaded neck portion of said actuating member;

(ii) a threaded connector ring connected to said upper portion of said housing of said adapter assembly for interconnecting said adapter assembly with the first container;

(iii) a rinsing assembly connected to said housing of said adapter assembly for rinsing the first container, said rinsing assembly including a fluid passageway and communication with said interior chamber of said housing of said adapter assembly; and (iv) a vent assembly connected to said housing of said adapter assembly for venting said interior chamber of said housing.

7. In a liquid transfer system as defined in claim 6 in which said punch cutter of said cutter assembly includes a generally triangular shaped frame and a generally circular shaped cutting edge carried by said frame for cutting the frangible seal of the first liquid container.

8. In a liquid transfer system as defined in claim 6 in which said cutter assembly includes base member and a punch rod connected to and spanning said punch cutter and said base member.

9. In a liquid transfer system as defined in claim 6 in which said vent assembly includes a vent housing having an interior space, a breather plug connected to said vent housing and extending into said interior space and an umbrella check valve disposed within said interior space.

10. In a liquid transfer system as defined in claim 6 in which said rinsing assembly comprises a connector body connected to said housing of said adapter assembly and a quick coupling assembly connected to said connector body for connecting said rinsing assembly with the source of fluid under pressure.

11. In a liquid transfer system as defined in claim 10 in which said rinsing assembly further includes a pressure relief valve connected to said connector body.

12. In a liquid transfer system as defined in claim 11 in which said pressure relief valve extends from said connector body in a direction substantially parallel to said axial centerline of said coupler body.

* * * * *